US011666947B2

(12) United States Patent
Uzzo

(10) Patent No.: US 11,666,947 B2
(45) Date of Patent: Jun. 6, 2023

(54) SELECTOR MACHINE

(71) Applicant: 3U VISION SRL, Imola (IT)

(72) Inventor: Andrea Uzzo, Imola (IT)

(73) Assignee: 3U VISION SRL, Imola (IT)

( * ) Notice: Subject to any disclaimer, the term of this patent is extended or adjusted under 35 U.S.C. 154(b) by 0 days.

(21) Appl. No.: 17/505,866

(22) Filed: Oct. 20, 2021

(65) Prior Publication Data

US 2022/0118484 A1 Apr. 21, 2022

(30) Foreign Application Priority Data

Oct. 21, 2020 (IT) ..... 202020000005884

(51) Int. Cl.
*B07C 5/342* (2006.01)

(52) U.S. Cl.
CPC ..... *B07C 5/3425* (2013.01)

(58) Field of Classification Search
CPC ..... B07C 1/02; B07C 5/3425
USPC ..... 209/577, 581
See application file for complete search history.

(56) References Cited

U.S. PATENT DOCUMENTS 4,558,786 A * 12/1985 Lane ..... B07C 5/342 209/558
5,157,426 A * 10/1992 Kronberg ..... G02C 7/104 351/159.6
6,646,218 B1 * 11/2003 Campbell ..... B07C 5/367 209/582
10,288,594 B2 5/2019 Blanc
11,120,540 B2 * 9/2021 Mairhofer ..... H04N 5/2256
2008/0308471 A1 * 12/2008 Huber ..... B07C 5/366 209/577
2010/0110238 A1 * 5/2010 Kang ..... H04N 5/3572 348/E9.037

(Continued)

FOREIGN PATENT DOCUMENTS

EP 2992973 A1 3/2016
GB 2578180 A 4/2020

OTHER PUBLICATIONS

PhD thesis of Riccardo Gasbarrone; Innovative Techniques and Applications Sensors for the Characterization of Raw Material; PhD in Electrical, Materials and Nanotechnology Engineering Materials and Raw Materials Engineering ; D Ing. Riccardo Gasbarrone; Prof. Giuseppe Bonifazi; Feb. 25, 2020.

(Continued)

*Primary Examiner* — Joseph C Rodriguez

(57) ABSTRACT

Selector machine comprising an optical detection system provided with an emitter device and with an optical sensor adapted to detect a product to be selected. The emitter device comprises three IR sources, each of which emits electromagnetic radiations in a corresponding spectral band in the infrared spectrum. An electronic control unit alternately turns on the IR sources in corresponding separate time intervals, and the optical sensor detects, in each time interval, corresponding reflected radiations coming from the product. In addition, the electronic control unit comprises a processing module, which is provided with three chromatic channels of a RGB color space in order to associate the measurement signals corresponding to each IR source with a corresponding chromatic channel so as to compose a false color synthesis image of the product.

15 Claims, 3 Drawing Sheets

(56) References Cited

U.S. PATENT DOCUMENTS

| | | | | |
|---|---|---|---|---|
| 2011/0002536 | A1* | 1/2011 | Thomasson | G06V 20/693<br>382/165 |
| 2011/0317914 | A1* | 12/2011 | Omer | H04N 1/409<br>382/167 |
| 2017/0059406 | A1* | 3/2017 | Pelletier | G01J 3/36 |

OTHER PUBLICATIONS

Youtube: https://www.youtube.com/watch?v=T-hWEhDqVMU; CIMBRIA—Sea True—The true full-colors sorters; May 26, 2018; CIMBRIA S.r.l.

Youtube: https://www.youtube.com/watch?v=1kw5ECULbs8; Cimbria Sea Chrome Electronic Sorting—advanced vision-based electronic sorter; Aug. 28, 2014; Cimbria.

* cited by examiner

SELECTOR MACHINE

FIELD OF APPLICATION

The present finding regards a selector machine.

The present selector machine is inserted in the field of production of machines for the sorting of products, which are advantageously employed for identifying, within a bulk product, specific solid elements to be separated.

The present selector machine is, in particular, intended to be employed in the agricultural industry, for example in order to separate dried fruit from the corresponding shells before packaging, in the waste recovery and recycling industry, for example in order to separate waste made with plastic materials that are different from each other, or in any other field in which it is necessary to separate solid elements from each other in a bulk product on the basis in particular of their external appearance and/or of their chemical-physical properties.

State of the Art

Known on the market are selector machines, of automated type, which are employed in order to separate, within a product constituted by multiple objects, specific objects to be selected or to be discarded.

As is known, the selector machines are generally provided with a conveyance system on which a flow of a bulk product is made to advance, at its interior comprising multiple solid elements which must be distinct and separated from each other. Such bulk product can, for example, comprise dried fruit (such as peanuts, almonds, walnuts, which must be separated from their shells before being packaged), or it can comprise waste made of different material (e.g. plastic), which must be separated from each other in order to allow a correct disposal or recycling thereof.

For example, the conveyance system comprises one or more hoppers through which the product is made to flow within the machine itself through a system of slides, up to collection drawers.

Selector machines also comprise an optical detection system arranged for acquiring and analyzing images of the flow of bulk product, so as to distinguish, in the bulk product, the solid elements to be separated or discarded.

Such detection system is adapted to send control signals, based on the information obtained from the acquired images, to an expulsion device (such as a solenoid valves) actuatable to remove the selected solid elements from the bulk product, for example through the emission of compressed air jets.

More in detail, the optical detection system comprises optical emitters (e.g. constituted by LEDs) adapted to emit electromagnetic radiations towards the bulk product, and one or more optical sensors arranged for receiving the radiations reflected from the bulk product in order to obtain images of the product on the basis of which, by means of suitable thresholding algorithms, an electronic control unit determines which are the elements to be removed. In order to be able to distinguish, in the bulk product, solid elements substantially having the same color in the visible light spectrum, it is known to employ emitters and optical sensors that also operate in the near infrared spectrum. Indeed, elements having the same color in the visible spectrum generally have chemical-physical characteristics that determine a different absorption spectrum at the infrared wavelengths.

In particular, widespread on the market are selector machines in which the optical emitters generate wide spectrum radiations (with wavelengths both in the visible range and outside this) and the optical sensor is constituted by a hyperspectral video camera. The latter is capable of simultaneously acquiring a plurality of images, for example three hundred images, each containing information corresponding to a particular very narrow spectral band. The narrow spectral bands at which the images are acquired cover most of the electromagnetic radiation spectrum, from the ultraviolet to the infrared, and are extended for an amplitude not greater than 5 or 10 nm.

Therefore, such hyperspectral video cameras allow detecting, with a high degree of precision, chemical-physical characteristics of the elements to be separated not only by means of the detection of electromagnetic radiation in the near infrared spectrum, but simultaneously in the ultraviolet spectrum, the visible spectrum and in the infrared with greater wavelength spectrum.

The selector machine provided with hyperspectral video camera described briefly up to now has in practice demonstrated that it does not lack drawbacks.

The main drawback lies in the high cost of the hyperspectral video camera itself, which renders the optical detection system and, consequently, the selector machine extremely costly. A further drawback of the selector machine briefly described up to now lies in the low image acquisition frequency of the hyperspectral video camera, such acquisition frequency generally being comprised between 200 and 300 Hz.

A further drawback of the selector machine briefly described up to now is due to the very high quantity of data produced by the hyperspectral video camera, such data requiring processing by the electronic control unit which, consequently, must possess computation performances, with consequent increase of the machine manufacturing costs.

In addition, the high quantity of data to be processed can determine a relatively long reaction time by the electronic control unit in order to drive the expulsion device, with the risk of not intercepting the flow of product in the desired position due to the high advancement speed of the latter (even 4 m/s).

A further drawback of the selector machine briefly described above lies in the fact that it is unable to acquire images with high resolution, since the pixel matrix of the video camera is separated into multiple sectors, each of which associated with the corresponding optical filter, with the consequence that the image at each spectral band be defined by a limited number of pixels of the video camera itself.

PRESENTATION OF THE INVENTION

In this situation, the problem underlying the present finding is therefore that of eliminating the problems of the abovementioned prior art, by providing a selector machine, which has a high reliability and operative precision and, simultaneously, is inexpensive to attain.

A further object of the present finding is to provide a selector machine, which operates in an efficient manner, in particular without having to execute heavy computational processing by the electronic control unit.

A further object of the present finding is to provide a selector machine, capable of acquiring images with high degree of resolution.

BRIEF DESCRIPTION OF THE DRAWINGS

The technical characteristics of the present finding, according to the aforesaid objects, and the advantages thereof, will be more evident in the following detailed description, made with reference to the enclosed drawings, which represent a merely exemplifying and non-limiting embodiment of the invention, in which.

DETAILED DESCRIPTION OF A PREFERRED EMBODIMENT

Figure 1:
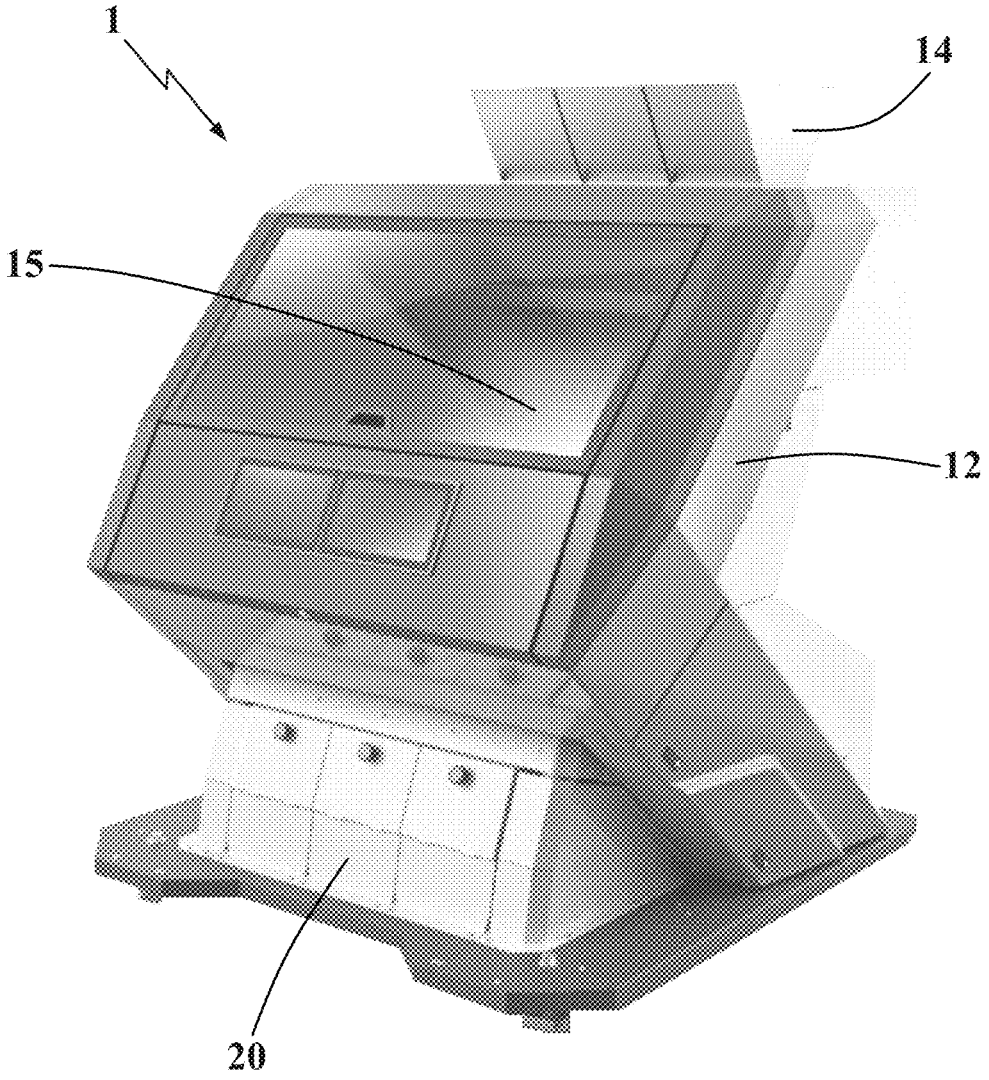
FIG. 1 shows a perspective view of a selector machine according to the present finding.

With reference to the enclosed figure, reference number 1 indicates a selector machine according to the present finding.

Advantageously, the present selector machine 1 is intended to be employed, in different application fields, for selecting specific elements in a product constituted by a set of solid elements, in particular with very similar shape and/or color.

More in detail, the present selector machine 1 is intended to be employed in the food industry, in particular so as to identify in a bulk product (in particular granular), such as for example dried fruit (peanuts, walnuts, almonds), seeds, grain or the like, elements which must be discarded before product packaging, which can for example be the shells of the dried fruit, discards of the working of the food product or other non-edible foreign bodies.

In addition, the present selector machine 1 can be employed in the industry of waste recovery, in particular so as to identify elements of specific materials (e.g. different plastic types) in order to be correctly disposed of or recycled.

The selector machine 1 comprises a conveyance system 2, which is arranged for advancing, along an advancement path A, at least one bulk product comprising multiple solid elements to be selected.

Preferably, the selector machine 1 comprises a support frame 12, which carries mounted thereon the conveyance system 2 and internally defines an operative volume 13 at least partially traversed by the advancement path A.

In accordance with the preferred embodiment illustrated in the enclosed figures, the conveyance system 2 comprises a hopper 14, through which the product is provided to the selector machine 1 and, more particularly, inserted in the operative volume 13 of the support frame 12, and a vibrating feeder (not illustrated) arranged for advancing the bulk product from the hopper 14 to a slide 15, along which the bulk product descends via gravity in order to be distributed and advance along the advancement path A.

Figure 2:
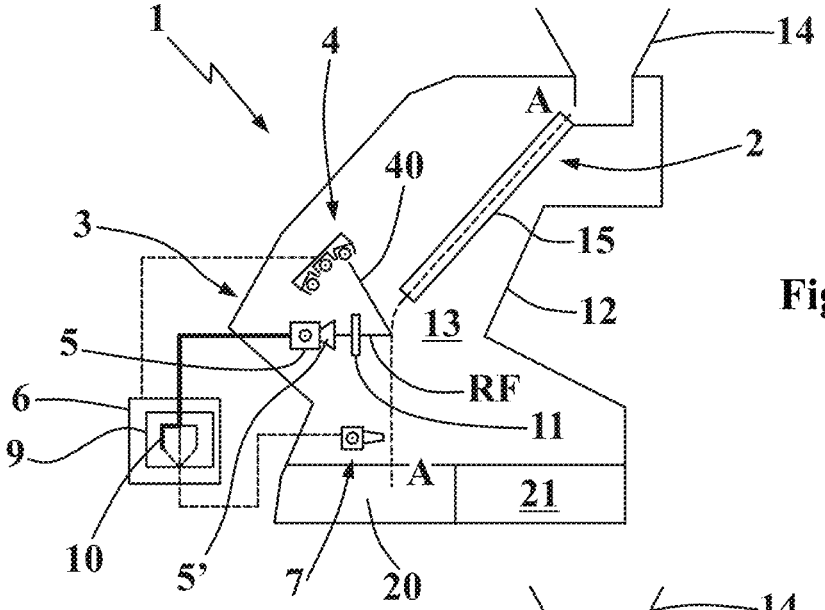
FIGS. 2, 3 and 4 show a schematic view, in lateral section, of the selector machine of FIG. 1, depicting the activation of different IR sources of the optical detection system of the selector machine itself.
Figure 3:
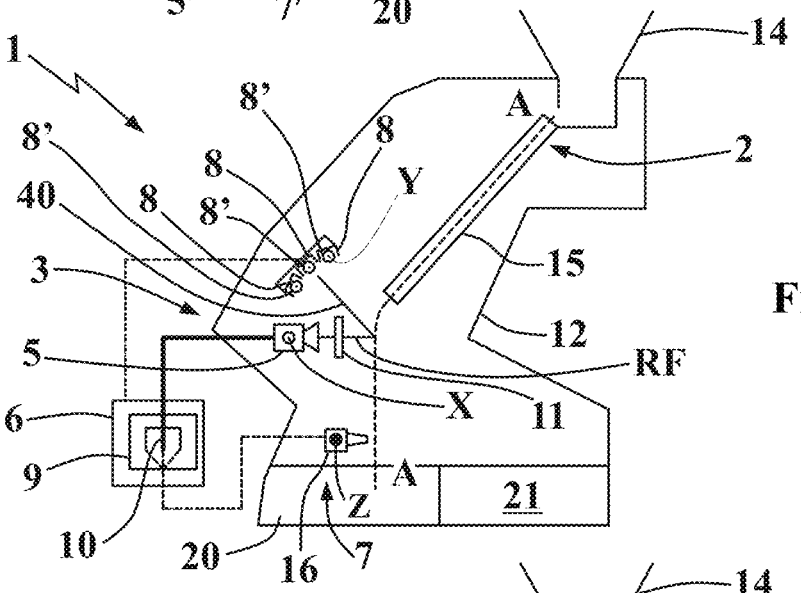
Figure 4:
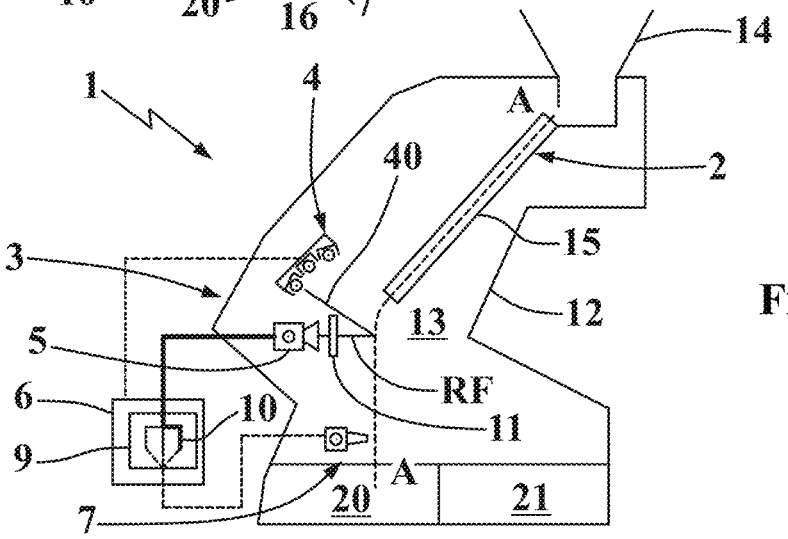

Advantageously, the selector machine 1 comprises at least one first collection space 20 in order to receive the product coming from the advancement path A, and at least one second collection space 21 in order to receive the solid elements selected from the aforesaid product flow, as schematized in FIGS. 2, 3 and 4.

Suitably, the selector machine 1 can comprise multiple advancement paths A (for example defined by corresponding hoppers 14, vibrating feeders and slides 15) with corresponding first and second collection spaces 20, 21, so as to select multiple products, even simultaneously.

The present selector machine 1 comprises an optical detection system 3 adapted to identify, in the product, the elements to be selected.

More in detail, the optical detection system 3 is provided with an emitter device 4, which is arranged for emitting, towards the advancement path A, electromagnetic radiations 40 adapted to hit the product, and with an optical sensor 5, which is directed towards the advancement path A and is arranged for receiving reflected radiations RF coming from the product irradiated by the electromagnetic radiations 40 and for transducing the reflected radiations RF into corresponding measurement signals.

In addition, the optical detection system 3 is provided with an electronic control unit 6 operatively connected to the optical sensor 5 in order to receive the measurement signals and arranged for emitting control signals, which are sent to an expulsion device 7 in order to remove the selected elements from the product, as discussed hereinbelow.

Advantageously, the optical detection system 3 is placed along the advancement path A, in particular below the slide 15 of the conveyance system 2, so as to detect the bulk product freely falling from the slide 15 itself with the solid elements to be selected spaced from each other.

The optical detection system 3 is preferably placed in the operative volume 13 defined inside the support frame 12, in a manner such that the support frame 12 itself screens the optical detection system 3 from light coming from the external environment and prevents it from interfering with the electromagnetic radiations 40 emitted by the emitter device 4 or with the reflected radiations RF coming from the product irradiated and received by the optical sensor 5.

The present selector machine 1 comprises (as anticipated above) an expulsion device 7 connected to the optical detection system 3 in order to receive the control signals from the electronic control unit 6. Such control signals are adapted to drive the expulsion device 7 to eliminate from the advancement path A specific solid elements of the product, which are selected based on the information acquired from the optical detection system 3.

Preferably, the expulsion device 7 comprises multiple nozzles 16 placed side-by-side each other along a longitudinal direction Z substantially transverse to the advancement path (e.g. horizontal) and in particular parallel to the lying plane of the slide 15.

Advantageously, the nozzles 16 are placed below the optical detection system 3, are directed towards the advancement path A and are actuatable, based on the control signals sent by the electronic control unit 6, each by means of a corresponding solenoid valve, to emit a compressed air jet towards the flow of the bulk product.

In particular, each nozzle 16 is operatively associated with a specific point of the advancement path A (for example according to a specific position grid), in a manner such that the actuation of each nozzle 16 generates an air flow that hits the elements that pass into such specific point of the advancement path A.

In this manner, the solid elements that must be separated from the rest of the bulk product are hit by the compressed air jet emitted by one of the nozzles 16 of the expulsion device 7 and are effectively diverted from the advancement path A while they freely falling from the slide 15 of the conveyance system 2, preferably being conveyed towards the second collection space 21.

According to the idea underlying the present finding, the emitter device 4 comprises at least three IR sources 8, each of which arranged for emitting electromagnetic radiations 40 in a corresponding distinct spectral band 80 in the infrared spectrum.

In accordance with the embodiment illustrated in FIGS. 2-4, the emitter device 4 comprises three IR sources 8. Suitably, the emitter device 4 can also comprise more than three IR sources 8, of which three will be enabled for operation.

With the term "spectral band", it must be intended hereinbelow an interval of selected wavelengths of the electromagnetic radiations 40.

In addition, the electronic control unit 6 is operatively connected to the emitter device 4 and is arranged for alternately turning on the IR sources 8 one after the other in corresponding and separate time intervals $T_{ON}$ and the optical sensor 5 is arranged for detecting, in each time interval $T_{ON}$, corresponding reflected radiations RF coming from the product irradiated by the corresponding IR source 8, and for generating corresponding measurement signals.

The electronic control unit 6 comprises, in addition, a processing module 9, which is provided with three chromatic channels 10 of a RGB color space, i.e. in particular a channel of the red R, a channel of the green G and a channel of the blue B. The processing module 9 is arranged for associating the measurement signals corresponding to each IR source 8 with a corresponding chromatic channel 10 in order to compose a false color synthesis image of the product.

The electronic control unit 6 is adapted to generate the control signals, and then identify the elements to be selected, as a function of the aforesaid synthesis image.

During use, the electronic control unit 6 turns on in a first time interval $T_{ON}$ a first of the IR sources 8 with the other IR sources 8 inactive, such that the bulk product is only irradiated with electromagnetic radiations 40 at the spectral band 80 of the aforesaid IR source 8. The irradiated product absorbs several of the electromagnetic radiations 40 and reflects the reflected radiations RF having wavelengths in any case comprised in the corresponding spectral band 80, which are received by the optical sensor 5 in order to generate a measurement signal, preferably in the form of a grayscale image. Such grayscale image, preferably, is not intended to be shown, e.g. through a monitor of the selector machine 1, to a user, but rather to be processed as computer data by the software of the electronic control unit 6. The aforesaid measurement signal, or more particularly the information contained in each pixel of the grayscale image, will only depend on the intensity of the reflected radiation RF at wavelengths comprised in the spectral band 80 of the corresponding IR source 8. In addition, such measurement signal is mapped on a first of the chromatic channels 10 of the processing module 9, as represented in FIG. 2, for example the channel of the red R in the RGB color space in which the synthesis images are processed. In a successive second time interval $T_{ON}$, the first of the IR sources 8 is deactivated by the electronic control unit 6 and a second of the aforesaid IR sources 8 is turned on in order to irradiate the bulk product with electromagnetic radiations 40 at a different spectral band 80. The optical sensor 5 therefore generates a second measurement signal which is associated by the processing module 9, as represented in FIG. 3, with a second of the chromatic channels 10, for example the channel of the green G in the RGB color space. The same process is repeated with a third of the IR sources 8, such that the optical sensor 5 generates a measurement signal that is mapped by the processing module 9, as represented in FIG. 3, with a third of the chromatic channels 10, e.g. the channel of the blue B in the RGB color space. Such sequential activation of the IR sources is cyclically repeated.

Advantageously, the electronic control unit 6 is provided with at least one thresholding software, per se of known type (and hence not discussed hereinbelow), which defines the criteria with which the electronic control unit 6 determines, based on the synthesis images, the elements to be selected and, consequently, the control signals to be sent to the expulsion device 7.

In particular, the use of IR sources 8 allows distinguishing, from each other, solid elements of the bulk product having substantially the same color in the visible spectrum but chemical-physical characteristics which are different if irradiated with electromagnetic radiations belonging to the infrared spectrum.

For example, peanuts and the corresponding shells substantially have the same color in the visible spectrum but are provided with a different moisture and fat quantity, which make the peanuts and the shells themselves absorb—if irradiated with electromagnetic radiations in the infrared spectrum—different wavelengths of the same electromagnetic radiation.

Analogously, plastic materials having the same color in the visible spectrum can be provided with polymer chains that have different chemical composition, which determine a different absorption of the electromagnetic radiations in the infrared spectrum.

In addition, the claimed arrangement of multiple IR sources 8 actuatable to sequentially emit the electromagnetic radiations 40 at distinct spectral bands 80 renders the present selector machine 1 particularly inexpensive to manufacture. Indeed, a sensor with wide spectrum can be employed as optical sensor 5, which is only capable of acquiring measurement signals that depend on the mean of the intensity of all the reflected radiations RF incident thereon, independent on their wavelength. Indeed, it is not necessary that the optical sensor 5 be provided with hyperspectral video camera, prisms, lattices, dichroic mirrors or other optical elements capable of separating the reflected radiations RF from the bulk product based on their wavelengths in order to simultaneously generate measurement signals which separately depend on the intensity at selected spectral bands, since the sequential actuation of the IR sources 8 in time intervals $T_{ON}$ not overlapped on each other ensures that the acquired measurement signals each depend only on the intensity of the reflected radiations RF at the respective selected spectral band 80. Consequently, the selection or separation of the wavelengths at which each measurement signal is acquired is not executed at the optical sensor 5, but rather upstream thereof, at the emitter device 4, whose IR sources 8 are sequentially actuated.

In order to effectively generate the false color synthesis image by means of three measurement signals acquired in time intervals $T_{ON}$ in sequence, the optical sensor 5 has an acquisition frequency substantially comprised between 15 and 25 kHz, preferably equal to the sequential turning-on frequency of the IR sources 8.

Indeed, the acquisition frequency is so high that, with each acquisition, the movement executed by the solid elements of the bulk product (which travel along the advancement path A with a speed generally equal to about 4 m/s) is so small that three subsequent acquisitions can be considered (corresponding to the sequential activation of the three IR sources) relative to a same position along the advancement path A.

In particular, the present selector machine 1 is capable of acquiring the measurement signals and processing the synthesis images with a frequency that is so high with respect to the vision machines of known type discussed above, since the optical sensor 5 only acquires three measurement signals for each synthesis image, and such measurement signals allow distinguishing, with sufficient precision, the solid elements of the bulk product without overloading the processing module 9, and the processing module 9 generates the synthesis image starting from the reduced quantity of data contained in the only three measurement signals mapped in the chromatic channels 10, employing algorithms that are typical of the RGB color space, which require easier implementation with respect to the typical algorithms of infrared image processing.

The spectral band 80 of the electromagnetic radiations 40 emitted by each IR source 8 is advantageously contained within the short wave infrared spectrum, which is known in the technical jargon of the field with the initials "SWIR" (Short Wave Infrared). The wavelengths in the SWIR have proven particularly efficient for distinguishing the different solid elements of the bulk product based on chemical-physical characteristics, therefore increasing the reliability and operating efficiency of the selector machine 1.

Advantageously, the wavelengths of the spectral band 80 are substantially comprised between 900 nm and 2200 nm.

The optical sensor 5 comprises, advantageously, at least one row of optical transducers 5' extended along an extension direction X substantially transverse to the advancement path A, preferably substantially parallel to the width-wise extension of the slide 15 and, in particular horizontal.

Advantageously, the optical transducers 5' of the optical sensor 5 are InGaAs solid state transducers, which are particularly adapted to detect the reflected radiations RF in the spectral bands 80 of the short wave infrared spectrum.

Preferably, the optical sensor 5 comprises a linear video camera (provided with the aforesaid row of optical transducers 5'), also possibly in black and white.

Preferably, the measurement signals generated by the optical sensor 5 contain information that represents images in grayscale in a linear vector form of pixels, in which each pixel corresponds to one of the InGaAs solid state transducers of the aforesaid row of optical transducers 5'.

Therefore, the false color synthesis image processed by the processing module 9 every three successive time intervals $T_{ON}$ is in turn preferably in a linear vector form of pixels.

In addition, the processing module 9 is preferably arranged for composing an overall image in the form of a two-dimensional pixel matrix, starting from multiple false color synthesis images in a linear vector form of pixels which are sequentially processed and for amplifying every three time intervals $T_{ON}$ the aforesaid overall image, by adding the corresponding synthesis image, in a manner such that the solid elements of the bulk product are easily identifiable by the electronic control unit 6.

As reported above, the optical sensor 5 advantageously comprises a linear video camera in black and white, which generates, as measurement signals, images in grayscale in a linear vector form of pixels.

Such configuration of the optical sensor 5 (in particular like a black and white video camera) allows it to generate measurement signals that are not particularly heavy (in particular allowing information relative to black and white images), in this manner allowing the processing module 9 to compose the synthesis image through the processing of a relatively reduced quantity of data (in particular compared with color video cameras) and in particularly quick time periods. In addition, the acquisition, instant by instant, of measurement signals relative to images in linear vector form of pixels involves that, with each acquisition, it is necessary to transmit, by means of the communication BUS, a reduced quantity of data (with respect to a hyperspectral video camera) from the optical sensor 5 to the electronic control unit 6, hence rendering such transmission particularly quick.

In this manner, in particular, the quick times for processing and transmitting the data allow positioning the nozzles 16 of the expulsion device 7 just below the optical detection system 3 and, therefore, close to the slide 15 of the conveyance system 2, since the electronic control unit 6 is capable of sending the control signals to the expulsion device 7 itself in extremely reduced time intervals. In addition, the precision in removing, from the advancement path A, the solid elements is increased since with the decrease of the distance of the expulsion device 7 from the optical detection system 3 and from the lower edge of the slide 15, the possible variations of the drop speed of the solid elements to be diverted are decreased, considerably reducing the risk that a compressed air jet emitted by one of the jets 16 arrive early or late with respect to the solid element identified by the electronic control unit 6.

Advantageously, the electronic control unit 6 comprises at least one electronic processor suitably implemented in a corresponding circuit board. Suitably, the processing module 9 can be integrated in the aforesaid electronic processor, for example by means of a corresponding software, or obtained with a distinct firmware.

Advantageously, the electronic control unit 6 can be integrated in the optical sensor 5, in particular in the video camera of the latter (obtained for example with a smart camera). Suitably, each IR source 8 advantageously comprises at least one LED 8', in particular so as to maintain constant over time the characteristics of intensity and wavelength of the electromagnetic radiations 40 emitted by the emitter device 4 with ease.

Advantageously, each IR source 8 comprises at least one row of the aforesaid LED 8', which is extended along an extension direction Y substantially transverse to the advancement direction A, preferably substantially parallel to the width-wise extension of the slide 15 and, in particular horizontal.

The rows of LED 8' of the IR sources 8 are advantageously placed with their extension directions Y substantially parallel to the extension direction X of the row of optical transducers 5' of the optical sensor 5.

In this manner, the electromagnetic radiation 40 emitted by the row of LEDs 8' of each IR source 8 has a substantially zero gradient of intensity and wavelength along all the directions parallel to the extension direction Y and, consequently, to the extension direction X of the row of optical transducers 5', with consequent increase of the quality of the acquired measurement signals.

Preferably, each IR source 8 is provided with two rows of LED 8', both arranged for emitting electromagnetic radiations 40 at the corresponding spectral band 80, which are placed in a substantially symmetric manner with respect to the optical axes of the row of optical transducers 5', so as to illuminate the solid elements of the bulk product from two different directions, reducing the shadows thereon.

In accordance with an embodiment not illustrated in the enclosed figures, the optical sensor 5 comprises two rows of optical transducers 5' which are opposite with respect to the advancement path A, so as to acquire the measurement signals relative to the bulk product from two different viewpoints, a front and a rear, and each IR source 8 of the emitter device comprises at least two rows of LED 8', including one for each row of optical transducers 5', which are extended along extension directions Y parallel to each other and to the extension directions X of the rows of optical transducers 5' and are arranged for emitting electromagnetic radiations 40 from opposite directions with respect to the advancement path A itself.

Advantageously, the electronic control unit 6 is arranged for sending, to the IR sources 8, trigger signals 60, 60' which are synchronized with the processing module 9.

Figure 5:
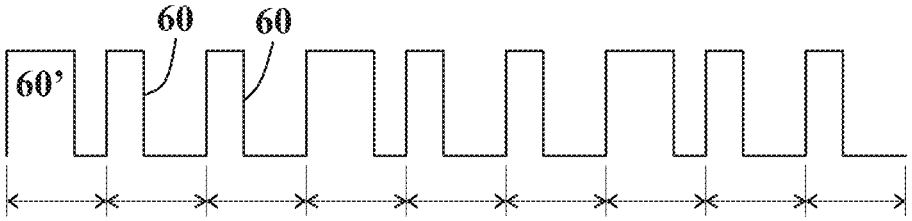
FIG. 5 shows an example of time progression of trigger signals generated by the electronic control unit of the selector machine in order to control, in a synchronized manner, the emission and the acquisition of the electromagnetic radiations.

More in detail, with reference to FIG. 5, the electronic control unit 6 is provided with a synchronized control module arranged for generating the aforesaid trigger signals 60, 60' in groups of three, of which the first trigger signal 60' of the trigger signals 60, 60' has greater time extension with respect to the second and third trigger signals 60.

Such first trigger signal 60' with greater time extension allows the IR sources 8 of the emitter device 4 to be resynchronized with the processing module 9 every three acquisitions of the measurement signals by the optical sensor 5, even in the event in which there is an asynchrony between the IR sources 8, the optical sensor 5 and the processing of the measurement signals on the three chromatic channels 10 of the processing module 9 during the acquisition of three preceding measurement signals. Indeed, each time the emitter device 4, the optical sensor 5 and the processing module 9 detect a first trigger signal 60' having greater time extension, these recognize that three measurement signals have already been acquired at the respective spectral bands 80, regardless of whether the acquisition was executed correctly or in an asynchronous manner, and that it is necessary to proceed with the acquisition of subsequent three measurement signals.

The present selector machine 1 comprises, preferably, a bandpass filter 11 provided with at least three narrow spectral bands 110, each of which extended for a subset of wavelengths of the spectral band 80 of a corresponding IR source 8. More in detail, the bandpass filter 11 is positioned in a manner such to intercept the electromagnetic radiations 40 emitted by the IR sources 8 or the reflected radiations RF coming from the product.

The arrangement of a bandpass filter 11 to intercept the electromagnetic radiations 40 or the reflected radiations RF allows obtaining a more precise irradiation of the bulk product and, thus, detecting with greater precision the chemical-physical characteristics of the solid elements comprised therein.

Indeed, as is known, the LEDs 8' of the IR sources 8 can have a spectral band 80 with emission wider than that of interest, for example extended for an interval of wavelengths for about one hundred or two hundred nanometers, with maximum intensity at a central wavelength, for example indicated by the LED manufacturer, and intensities decreasing the further the wavelength is from such central wavelength.

The narrow bandwidths 110 of the bandpass filter 11 are substantially centered, each on a corresponding spectral band 80, such that through each narrow bandwidth 110 only the transmission of the electromagnetic radiations 40 which has the highest intensity of the spectral band 80 is allowed, and the transmission of the electromagnetic radiations 40 with lower intensity is prevented.

The bandpass filter 11 can be, preferably, provided with more than three narrow bandwidths 110, for example five, in a manner such that it can operate with multiple combinations of spectral bands 80 (i.e. by arranging multiple combinations of IR sources 8) without having to change such bandpass filter 11.

In this manner, the selector machine 1 can be adapted to sort, for example, dried fruit by installing, in the emitter device, 4 IR sources 8 at three spectral bands 80 corresponding to three of the five narrow bandwidths 110 of the bandpass filter 11, and for example to sort different types of plastic materials by installing IR sources 8 at three diverse spectral bands 80 corresponding to other three of the same five narrow bandwidths 110 of the bandpass filter 11.

Advantageously, each narrow spectral band 110 of the bandpass filter 11 has a bandwidth 111 substantially comprised between 15 and 35 nm and, still more preferably, substantially comprised between 20 and 30 nm.

In addition, the narrow spectral bands 110 of the bandpass filter 11, advantageously, are not overlapped on each other.

More in detail, the narrow spectral bands 110 are spaced from each other by an interval of electromagnetic radiation such that, even if IR sources 8 with particularly wide spectral band 80 are employed, none of the electromagnetic radiations 40 emitted by one of the three IR sources 8 is transmitted through a narrow bandwidth 110 adjacent to that centered on the spectral band 80 of the corresponding IR source 8.

Figure 6:
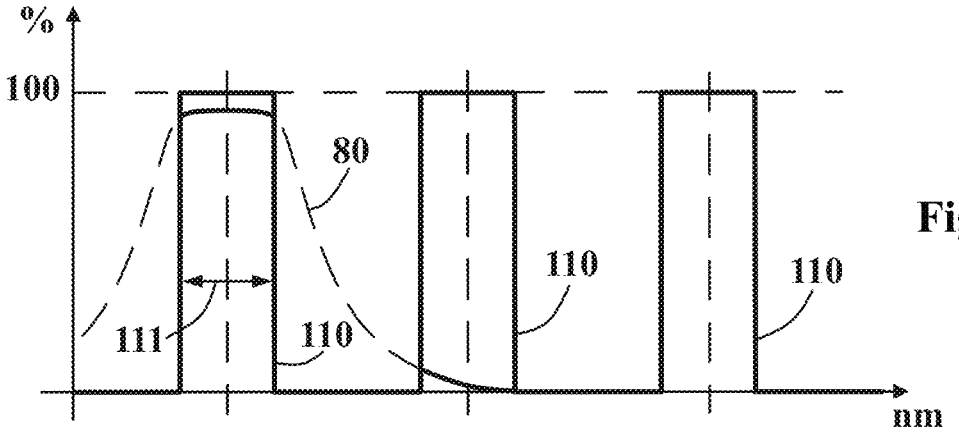
FIGS. 6, 7 and 8 show respective graphs, which illustrate the filtering action of a bandpass filter of the selector machine, which is provided with three narrow bandwidths, on the electromagnetic radiations determined by the IR sources of the optical detection system.
Figure 7:
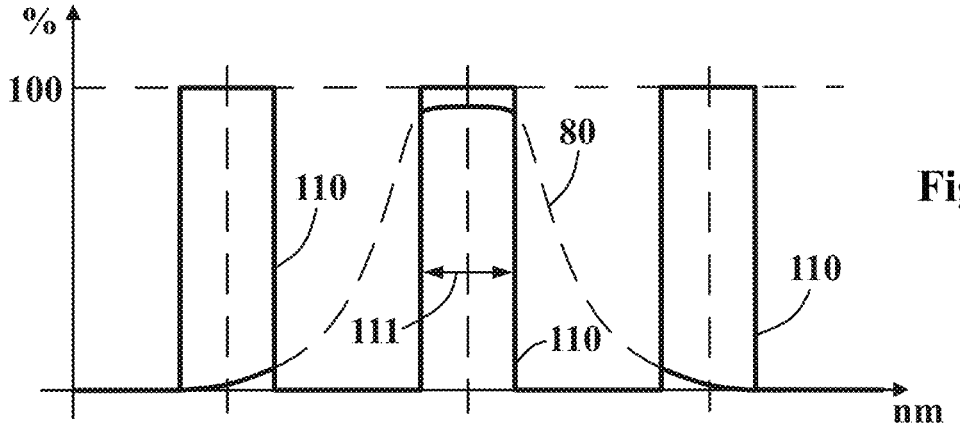
Figure 8:
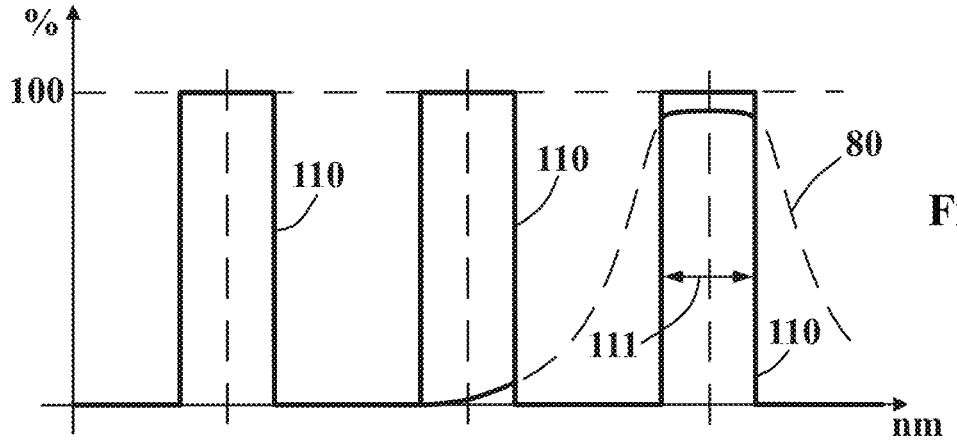

Nevertheless, the correct operation of the optical detection system 3 is ensured also in the event in which the narrow spectral bands 110 are spaced from each other by an interval of electromagnetic radiation such to allow only the electromagnetic radiations 40 at lower intensity of each spectral band 80 to be transmitted through a narrow bandwidth 110 adjacent to that centered on the spectral band 80 of the corresponding IR source 8, as illustrated in the FIGS. 6, 7 and 8, which show, in a graph having the wavelengths on the x-axis and the percentage of light intensity that is transmitted through the bandpass filter 11 on the y-axis, the portion of electromagnetic radiations 40 of each spectral band 80 transmitted through the narrow bandwidths 110 with each IR source 8 separately actuated.

Advantageously, the bandpass filter 11 is positioned between the advancement path A and the optical sensor 5 in order to intercept the reflected radiations RF coming from the product. Still more preferably, the bandpass filter 11 is mounted on the optical sensor 5, in a manner such that all the reflected radiations RF incident on the optical sensor 5 are intercepted by the bandpass filter 11 itself.

In accordance with a different embodiment, not illustrated in the enclosed figures, the bandpass filter 11 is positioned between the advancement path A and the emitter device 4 in order to intercept the electromagnetic radiations 40 emitted by the IR sources 8 of the emitter device 4. More particularly, the aforesaid bandpass filter 11 is mounted directly on the emitter device 4 itself, in a manner such that all the electromagnetic radiations 40 are intercepted by the bandpass filter 11 itself.

The finding thus conceived therefore attains the pre-established aims.

The contents of the Italian patent application number 202020000005884, from which this application claims priority, are incorporated herein by reference.

What is claimed is:

1. A selector machine, comprising:

a conveyance system, which is arranged for advancing, along an advancement path, at least one bulk product comprising multiple solid elements to be selected;

an optical detection system comprising:

an emitter device arranged for emitting, towards said advancement path, electromagnetic radiations adapted to hit said at least one product;

an optical sensor directed towards said advancement path and arranged for receiving reflected radiations coming from said at least one product irradiated by said electromagnetic radiations, and for transducing said reflected radiations into corresponding measurement signals;

an electronic control unit operatively connected to said optical sensor in order to receive said measurement signals, and arranged for emitting control signals;

an expulsion device connected to said optical detection system in order to receive said control signals, which are adapted to drive said expulsion device to eliminate, from said advancement path, specific solid elements of said at least one product;

wherein:

said emitter device comprises at least three IR sources, each of which is arranged for emitting electromagnetic radiations in a corresponding separate spectral band in the infrared spectrum;

said electronic control unit is operatively connected to said emitter device and is arranged for alternately turning on said IR sources one after the other, in corresponding and separate time intervals;

said optical sensor is arranged for detecting, in each said time interval, corresponding said reflected radiations coming from said at least one product irradiated by the corresponding said IR source, and to generate corresponding said measurement signals;

said electronic control unit comprises a processing module, which is provided with at least three chromatic channels of a RGB color space and is arranged for associating the measurement signals corresponding to each said IR source with a corresponding chromatic channel of said chromatic channels and for composing a false color synthesis image of said at least one product by means of three said measurement signals acquired every three successive said time intervals; said electronic control unit being configured to generate said control signals as a function of said synthesis image.

2. The selector machine of claim 1, wherein the spectral band of the electromagnetic radiations emitted by each said IR source is contained within the short wave infrared spectrum.

3. The selector machine of claim 1, wherein the wavelengths of said spectral band are substantially comprised between 900 nm and 2200 nm.

4. The selector machine of claim 1, wherein said optical sensor comprises at least one row of optical transducers extended along an extension direction substantially transverse to said advancement path.

5. The selector machine of claim 4, wherein said optical transducers are InGaAs solid state transducers.

6. The selector machine of claim 1, wherein each said IR source comprises at least one LED.

7. The selector machine of claim 6, wherein each said IR source comprises at least one row of LEDs; wherein said at least one row of LEDs is extended along an extension direction substantially transverse to said advancement direction.

8. The selector machine of claim 4, wherein each said IR source comprises multiple rows of LED;

wherein said rows of LED are placed with said extension directions substantially parallel to the extension direction of said rows of optical transducers.

9. The selector machine of claim 1, wherein said optical sensor has an acquisition frequency substantially comprised between 15 and 25 kHz.

10. The selector machine of claim 1, wherein said electronic control unit is arranged for sending, to said IR sources, trigger signals synchronized with said processing module.

11. The selector machine of claim 1, further comprising a bandpass filter provided with at least three narrow spectral bands, each of which extended for a subset of wavelengths of the spectral band of a corresponding said IR source; said bandpass filter being positioned in a manner such to intercept said electromagnetic radiations emitted by said IR sources or said reflected radiations coming from said at least one product.

12. The selector machine of claim 11, wherein said bandpass filter is positioned between said advancement path and said optical sensor in order to intercept the reflected radiations coming from said at least one product.

13. The selector machine of claim 11, wherein said bandpass filter is positioned between said advancement path and said optical sensor in order to intercept the reflected radiations coming from said at least one product; wherein said bandpass filter is mounted on said optical sensor.

14. The selector machine of claim 11, wherein each said narrow spectral band of said bandpass filter has a bandwidth substantially comprised between 15 and 35 nm.

15. The selector machine of claim 11, wherein the narrow spectral bands of said bandpass filter are not overlapped on each other.

* * * * *